US009878434B2

(12) United States Patent
Hecht et al.

(10) Patent No.: US 9,878,434 B2
(45) Date of Patent: Jan. 30, 2018

(54) POWER DRILL

(75) Inventors: Joachim Hecht, Magstadt (DE); Martin Kraus, Filderstadt (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1186 days.

(21) Appl. No.: 13/880,327

(22) PCT Filed: Sep. 28, 2011

(86) PCT No.: PCT/EP2011/066891

§ 371 (c)(1),
(2), (4) Date: Jun. 20, 2013

(87) PCT Pub. No.: WO2012/052268

PCT Pub. Date: Apr. 26, 2012

(65) Prior Publication Data

US 2013/0269461 A1 Oct. 17, 2013

(30) Foreign Application Priority Data

Oct. 20, 2010 (DE) ..... 10 2010 042 682

(51) Int. Cl.
*B25F 5/00* (2006.01)
*B25D 16/00* (2006.01)
(Continued)

(52) U.S. Cl.
CPC ..... *B25F 5/001* (2013.01); *B25B 23/141* (2013.01); *B25D 11/106* (2013.01);
(Continued)

(58) Field of Classification Search
USPC ..... 173/48
See application file for complete search history.

(56) References Cited

U.S. PATENT DOCUMENTS 6,142,242 A * 11/2000 Okumura ..... B25B 23/141 173/216
6,142,243 A * 11/2000 Mayer ..... B25B 23/14 173/176
(Continued)

FOREIGN PATENT DOCUMENTS

CN 1943994 4/2007
DE 198 09 133 9/1999
(Continued)

OTHER PUBLICATIONS

International Search Report for PCT/EP2011/066891, dated Dec. 22, 2011.

*Primary Examiner* — Hemant M Desai
*Assistant Examiner* — Mobeen Ahmed
(74) *Attorney, Agent, or Firm* — Norton Rose Fulbright US LLP; Gerard Messina

(57) ABSTRACT

A power drill having percussion drilling function, drilling function and screwing function has a gearing for transmitting the drive motion of a drive unit to a tool spindle. Furthermore, two latching elements are provided which, in the percussion drilling function, are in latching engagement and in the drilling or screwing position are in the disengaged state. A mode setting device has a rotatable supporting ring and a thrust ring, coupled to the supporting ring in a torsionally fixed manner which, in the screwing position is held on the gear housing in an axially displaceable manner.

16 Claims, 6 Drawing Sheets

(51) Int. Cl.
*B25D 11/10* (2006.01)
*B25B 23/14* (2006.01)
*B25B 21/02* (2006.01)

(52) U.S. Cl.
CPC ..... *B25D 16/003* (2013.01); *B25D 16/006* (2013.01); *B25B 21/026* (2013.01); *B25D 2216/0023* (2013.01); *B25D 2216/0084* (2013.01); *B25D 2250/165* (2013.01); *Y10T 74/19251* (2015.01)

(56) References Cited

U.S. PATENT DOCUMENTS 6,688,406 B1 * 2/2004 Wu ..... B25D 16/00 173/109
2002/0098938 A1 * 7/2002 Milbourne ..... B23Q 5/142 475/286
2003/0010511 A1 * 1/2003 Hecht ..... B25D 11/102 173/48
2004/0245005 A1 * 12/2004 Toyama ..... B25D 16/003 173/48
2005/0150669 A1 * 7/2005 Umemura ..... B23B 45/008 173/48
2006/0086514 A1 * 4/2006 Aeberhard ..... B25B 21/00 173/48
2006/0118380 A1 * 6/2006 Aeberhard ..... B25B 23/141 192/56.61
2006/0201688 A1 * 9/2006 Jenner ..... B25B 21/00 173/48
2006/0213675 A1 * 9/2006 Whitmire ..... B23B 45/008 173/48
2007/0163793 A1 * 7/2007 Aeberhard ..... B25D 16/006 173/48
2009/0194305 A1 * 8/2009 Xu ..... B25B 21/00 173/48
2010/0193206 A1 * 8/2010 Teng ..... B25B 21/02 173/48
2010/0200257 A1 * 8/2010 Scrimshaw ..... B23B 31/1238 173/47
2011/0147022 A1 * 6/2011 Roehm ..... B23B 31/1207 173/47
2011/0147024 A1 * 6/2011 Herr ..... B25B 23/141 173/48
2012/0111592 A1 * 5/2012 Limberg ..... B25B 21/026 173/48
2013/0333907 A1 * 12/2013 Hecht ..... B25B 23/141 173/48

FOREIGN PATENT DOCUMENTS

DE 10 2004 051911 4/2006
EP 1574294 9/2005

* cited by examiner

POWER DRILL

FIELD OF THE INVENTION

The present invention relates to a power drill having a percussion drilling function, a drilling function and a screwing function.

BACKGROUND INFORMATION

In German document DE 198 09 133 A1, a hand-guided drill driver is discussed which is able to be used as a power drill, a percussion power drill or an electrical screwdriver. The different types of operation of the power drill are set using an adjusting sleeve, a torque specification being possible for the use as a screwdriver, whereas in the percussion drill function and the drill function a rigid torque coupling is provided. The rigid coupling is produced with the aid of coupling parts which are to be transferred into a rotationally locking connection.

SUMMARY OF THE INVENTION

The exemplary embodiments and/or exemplary methods of the present invention are based on the object of being able to set securely the various operating types of a power drill over even a long operating time period.

According to the exemplary embodiments and/or exemplary methods of the present invention, this object may be attained by the features described herein. The further descriptions herein disclose expedient refinements.

In the power drill according to the exemplary embodiments and/or exemplary methods of the present invention, we are particularly concerned with a hand-held power drill, which has a driving device for driving a tool accommodated in a tool spindle. The driving device includes a drive unit, usually an electrical drive motor as well as a gearing coupled to the drive unit, such as a planetary transmission. The power drill is able to be operated in various operating types, in which a percussion drilling function, a drilling function or a screwing function is involved. In the percussion drilling function and the drilling function there is a fixed torque coupling between the tool spindle and the drive device, whereas in the screwing function an adjustable torque is able to be transmitted.

For the implementation of the percussion drilling function, two latching elements engage with each other in a latch-locking manner which in the drilling and screwing position are disengaged. The latching elements form a latching system in which a sine-shaped or saw tooth-like waveform is contacted and the axial motion resulting from this is transferred to the tool spindle. For this purpose, the tool spindle is advantageously held axially adjustable with respect to the gear housing.

For setting the various operating modes, a mode setting device is used, which includes a supporting ring that is rotatable by manual operation and a torsionally fixed thrust ring, that is coupled to the supporting ring, which is supported on the gear housing. The supporting ring is advantageously rotated with the aid of a manually operable mode setting sleeve. The supporting ring and the thrust ring are also supported rotatably about the longitudinal axis or the spindle axis, and jointly carry out the rotationally adjusting motion of the mode setting sleeve. A rotational position of the mode setting device is assigned respectively to the operating types percussion drilling function, drilling function and screwing function.

The thrust ring of the mode setting device supported on the gear housing, in the screwing position is held axially displaceable on the gear housing and, in the percussion drilling position as well as in the drilling position is axially fixed to the gear housing. By contrast, the supporting ring, with which the thrust ring is firmly connected in the rotational direction, is expediently supported fixedly in the axial direction and without the possibility of adjustment with respect to the gear housing.

Because of the axial adjusting motion in the screwing position, in the case in which the torque exceeds an adjustable threshold value, the thrust ring is able to lift off axially from the gear housing, whereby the torque limitation is achieved.

By contrast, in the percussion drilling and in the drilling position the thrust ring is fixed axially on the gear housing, so that in these operating types no torque limitation takes place, The axial fixing is advantageously achieved via form locking in the axial direction, and for the transfer between the axially secured position by form locking and the axial adjustment possibility, the thrust ring inclusive of the support ring being rotated, particularly with the aid of the mode setting sleeve. The axial form locking may be achieved via an engagement of a shoulder projecting radially inwards on the thrust ring in a corresponding recess, such as a circumferential groove on the gear housing. In the screwing position, on the other hand, having the possibility of axial adjustment, projection and recess, or rather circumferential groove are disengaged. The projection on the thrust ring and the recess, or rather the circumferential groove at one section of the gear housing may engage with one another at low tolerances, so that in particular, the overall tolerance in the axial transmission chain is low. In this way, a high adjustment accuracy is ensured over a long operating time period.

For the activation and deactivation of the percussion drilling function, one of the latching elements is held axially adjustable, and this latching element, or a component connected to the latching element is supported on an adjustment contour which is located on the supporting ring. The adjustment contour permits transferring the latching element between various axial positions, and thus transferring between the latching engagement with the additional latching element that is fixed on the housing side and a disengagement with it. In the latching engagement, the percussion drilling function is activated, but is deactivated in the disengagement. Via the adjustment contour, which extends expediently in the circumferential direction on the supporting ring, by a relative motion between the latching element, or the component held on it, and the supporting ring, the contour may be contacted, which leads to the desired axial adjustment of the latching element. The rotational motion of the supporting ring, in this case, may be generated using the mode setting sleeve, as was stated above.

The component coupled to the latching element, which contacts the adjustment contour on the supporting ring, is advantageously a locking part, which is held fixed to the housing in the rotational direction, but is held to be axially adjustable in the housing of the power drill, in common with the latching element. The latching element and the locking part are advantageously connected in a fixed manner, in the axial direction, to the tool spindle, but they do not carry out the rotational motion of the tool spindle.

The supporting ring and the thrust ring are advantageously developed as separate components. In order to achieve a coupling between these parts in the rotational direction, on the supporting ring, at least one protruding shoulder may be formed, which engages with a corresponding recess on the thrust ring. Furthermore, it is expedient that the supporting ring radially encompasses the thrust ring at least partially, so that the supporting ring at least partially has a larger diameter than the thrust ring. In the region between several recesses distributed over the circumference for the form-locking coupling with shoulders on the supporting ring, it may also be expedient to develop the thrust ring and the supporting ring so as to have the same diameter.

For setting the torque in the screwing position, a spring device having two spring retaining rings and at least one intermediately positioned spring element is provided, the spring device exerting an axial force on the thrust ring. The two spring retaining rings are axially at a distance from each other, and coupled to each other by force via the at least one intermediately positioned spring element. Distributed over the circumference, advantageously a plurality of spring elements, particularly pressure springs, are arranged between the spring retaining rings. On the side facing away from the thrust ring, the spring retaining ring of the spring device is to be adjusted axially by a torque setting sleeve, which is expediently supported rotatably, but axially fixed to the housing. The spring retaining ring, using a screw thread, may engage with an associated screw thread on the torque setting sleeve, so that, in response to a rotational motion of the torque setting sleeve, the spring retaining ring executes an axial adjusting motion based on the axial fixing of the torque setting sleeve. Because of this, the axial distance between the first spring retaining ring, lying directly on the thrust ring, and the second spring ring, acted upon by the torque setting sleeve, is reduced. This leads to a changed initial stress in the at least one spring element, and thus to a changed axial force that is exerted on the thrust ring. The torque transferable in the screwing function rises with increasing axial force.

The spring retaining ring contacting the thrust ring expediently has a smaller diameter than the supporting ring, and is encompassed by the supporting ring when in mounted position. In this way, a compact small-dimensioned embodiment is attained.

Moreover, in an advantageous embodiment, a latching spring element is provided, which acts on the torque setting sleeve with a cogging torque. In this way, a plurality of latching positions of the torque setting sleeve are able to be specified, in which the torque setting sleeve is acted upon respectively by one cogging torque. To adjust the torque setting sleeve, the cogging torque has to be overcome.

Further advantages and expedient implementations may be gathered from the further descriptions herein, the description of the figures and the drawings.

DETAILED DESCRIPTION

Figure 1:
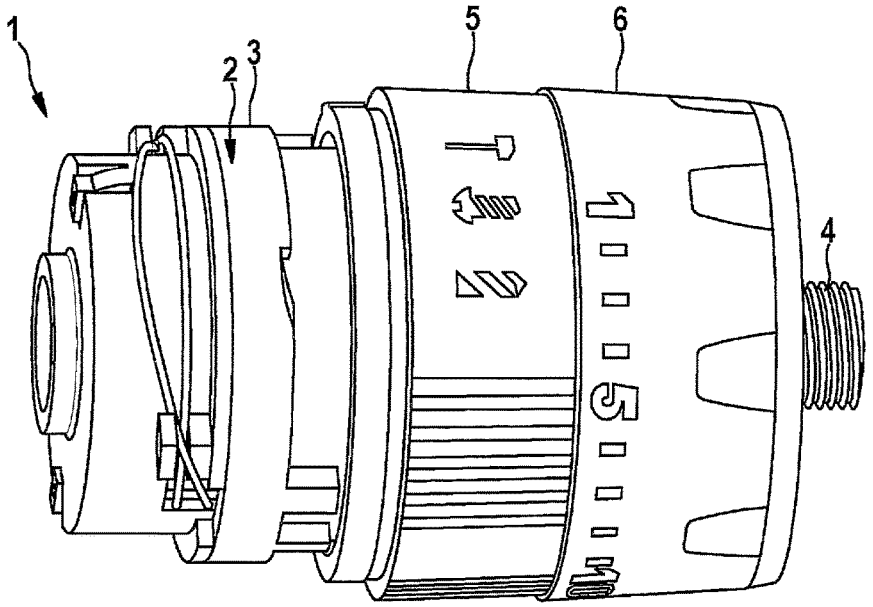
FIG. 1 shows a section of a power drill in a perspective view, having a gear housing and a mode setting sleeve for setting the operating mode and having a torque setting sleeve.

Identical elements are provided with the same reference numerals in the figures.

FIG. 1 shows a power drill 1 in a section, which is a hand-guided power drill having the functions percussion drilling, drilling and screwing. Power drill 1 has a drive device, which includes an electric drive motor as well as a gearing 2 in a gear housing 3. The rotational motion of the drive motor is transmitted to a tool spindle 4 via gearing 2 for accommodating the tool. To set the various operating modes, one may use a mode setting sleeve 5, which is supported with respect to gear housing 3 rotatably about the longitudinal axis of the power drill or the longitudinal axis of tool spindle. The functions percussion drilling, drilling and screwing may be set by a corresponding twisting of mode setting sleeve 5. Furthermore, a torque setting sleeve 6 is provided, which is directly adjacent to mode setting sleeve 5, and is also rotatable about the spindle's longitudinal axis. Sleeves 5 and 6 are able to be operated independently of each other. The maximally transferable torque in the screwing function is able to be set via torque setting sleeve 6.

Figure 2:
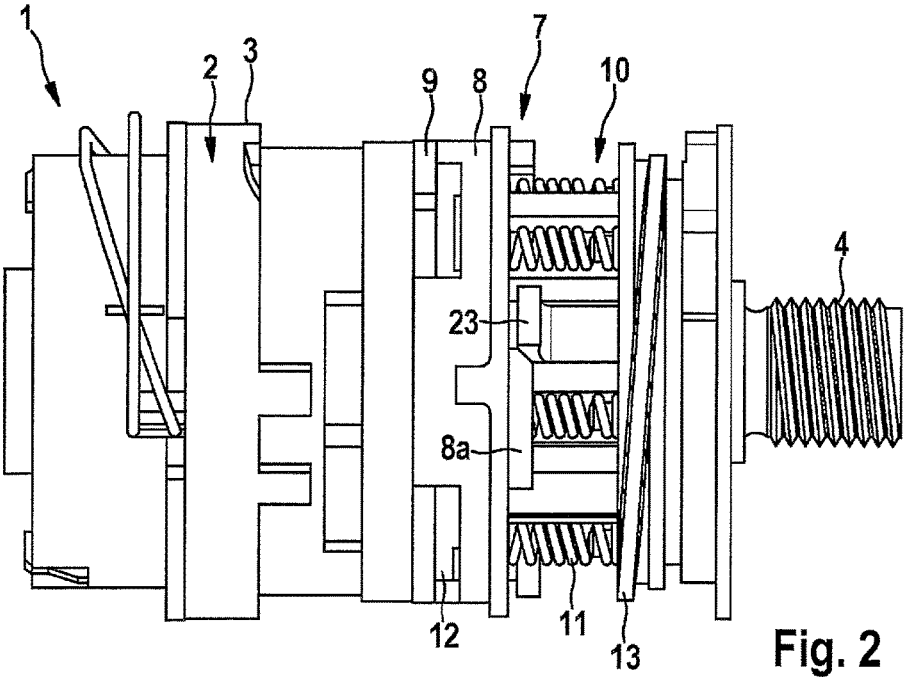
FIG. 2 shows the section of the power drill in a side view, but without a setting sleeve.

FIG. 2 shows the power drill without a mode setting sleeve 5 and without a torque setting sleeve 6. The power drill includes a mode setting device 7, to which belongs, on the one hand, mode setting sleeve 5 (FIG. 1) and, on the other hand, a supporting ring 8, as well as a thrust ring 9, which are each supported rotatably on gear housing 3. Thrust ring 9 is at a greater axial distance from the free end face of tool spindle 4 than supporting ring 8, and lies directly, or on balls, on a ring shoulder on gear housing 3. Supporting ring 8 is connected to thrust ring 9 in a fixed manner in the rotational direction. Supporting ring 8 is fixed in the axial direction essentially non-adjustably with respect to the housing, for tolerance reasons an axial clearance of motion from lying against the torque setting sleeve being able to be advantageous. Thrust ring 9 may basically carry out an axial adjusting motion with respect to housing 3 and supporting ring 8.

Furthermore, power drill 1 is equipped with a spring device 10, which has the function of establishing a maximally transferable torque in the screwing operation. To spring device 10 belong a plurality of spring elements 11 that are distributed over the periphery, which are each embodied as screwing pressure springs, as well as a first annular spring mounting on gear housing 3, as well as a second spring retaining ring 13 that is arranged in a manner offset in parallel. Spring elements 11 extend between the two spring retaining rings 12 and 13. Spring retaining ring 13 is able to be adjusted axially, whereby the initial stress in spring elements 11 is changed. First spring retaining ring 12 lies directly on thrust ring 9 of mode setting device 7, and acts upon it using an axial force against gear housing 3. With increasing initial stress of spring elements 11, the axial force that is exerted by spring device 10 on thrust ring 9 thus also grows.

Mode setting sleeve 5 is coupled in a torsionally fixed manner to supporting ring 8 which, on its part, is connected in a torsionally fixed manner to thrust ring 9. Consequently, in response to a rotational motion of mode setting sleeve 5, both supporting ring 8 and thrust ring 9 are rotated about the longitudinal axis.

Figure 3:
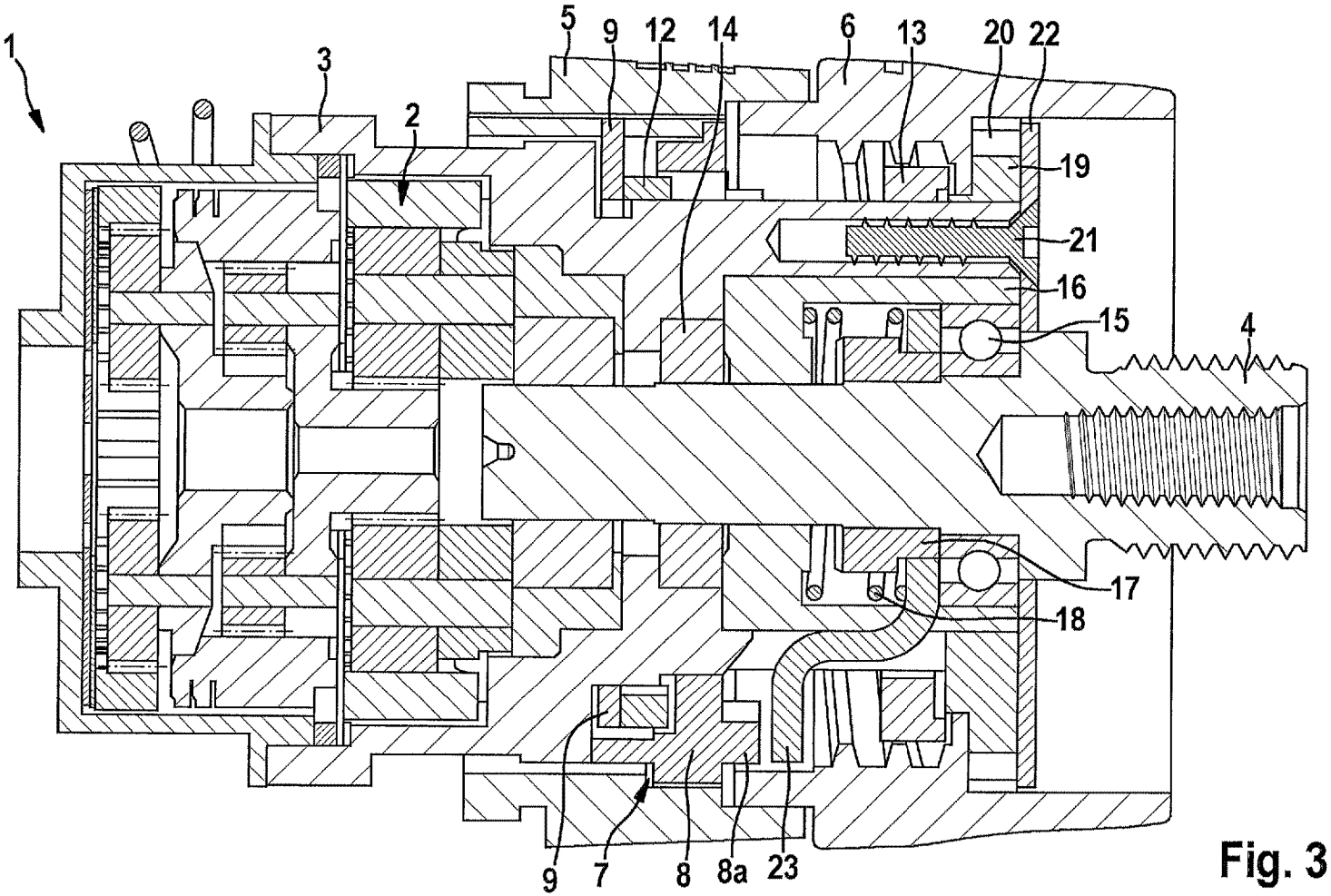
FIG. 3 shows a section through the power drill.

FIG. 3 shows a section through power drill 1. Tool spindle 4 is supported rotatably with respect to gear housing 3 via two axially distanced ball bearings 14 and 15. In addition to the rotational motion, tool spindle 4 may also carry out an axial adjusting motion with regard to gear housing 3. For this purpose, second ball bearing 15 is connected axially rigidly to tool spindle 4 and supported displaceably within a latching pot 16 that is fixed to the housing. First ball bearing 14, by contrast, is arranged fixed to the housing. Because of the axial displacement, tool spindle 4 is adjusted between the percussion drilling position and the drilling and screwing position. In the percussion drilling position, tool spindle 4 is shifted to the left, that is, into the gear housing. In the process, latching pot 16 gets into latching engagement with a latching disk 17, which is positioned torsionally fixed on the lateral surface of tool spindle 4. Latching disk 17 additionally has the task of fixing ball bearing 15, which is also positioned on the lateral surface of tool spindle 4, axially on the tool spindle.

A spring element 18 is situated within latching pot 16, which acts with force to bring tool spindle 4 into the latching position, in which latching pot 16 and latching disk 17 are in latching position.

Spring retaining ring 13 which, in common with first spring retaining ring 12 and the spring elements, lying in-between, forms the spring device, is screwed to torque setting sleeve 6, torque setting sleeve 6 being axially fixed in position, whereas spring retaining ring 13 is axially adjustable. In response to a rotational motion of torque setting sleeve 6, spring retaining ring 13 moves axially based on the screwing connection, whereby the initial stress of the spring device is changed.

In order for torque setting sleeve 6 to be latched in discrete latching positions, torque setting sleeve 6 is acted upon with force by a latching spring element 20, which is retained at latching spring retainer 19, latching spring retainer 19 and latching spring element 20 being situated in the internal space encompassed by torque setting sleeve 6. Latching spring element 20 latches in at discrete angular positions by a latching contour on the inside of torque setting sleeve 6 being acted upon by latching spring element 20.

Torque setting sleeve 6 is axially fixed in position on gear housing 3. This takes place with the aid of a screw 21, which connects a sheet metal 22 to gear housing 3, sheet metal 22 acting with force axially upon latching spring retainer 19 holding it against a shoulder on torque setting sleeve 6, and in this way also axially secures torque setting sleeve 6.

A locking part 23 is fixedly connected to latching disk 17, which lies against supporting ring 8. On an end face, supporting ring 8 has an adjusting contour with which locking part 23 makes contact and transmits it to latching disk 17. Axial height changes in the adjusting contour on supporting ring 8, because of the contact with locking part 23, are transmitted onto latching disk 17, so that latching disk 17 experiences a corresponding axial position change. In this way, the latching engagement between latching disk 17 and latching pot 16 is able to be controlled.

Figure 4:
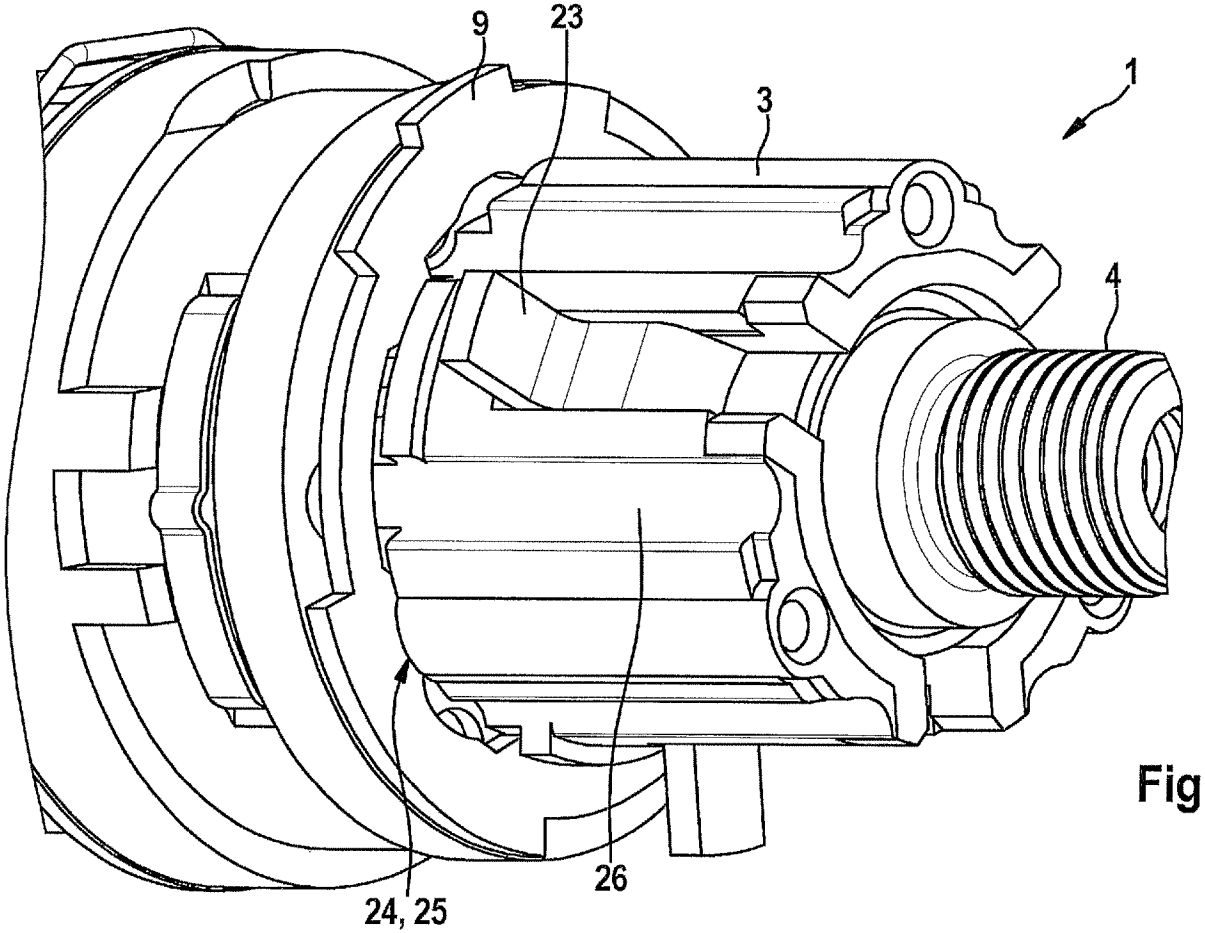
FIG. 4 shows the power drill in a percussion drilling position.
Figure 5:
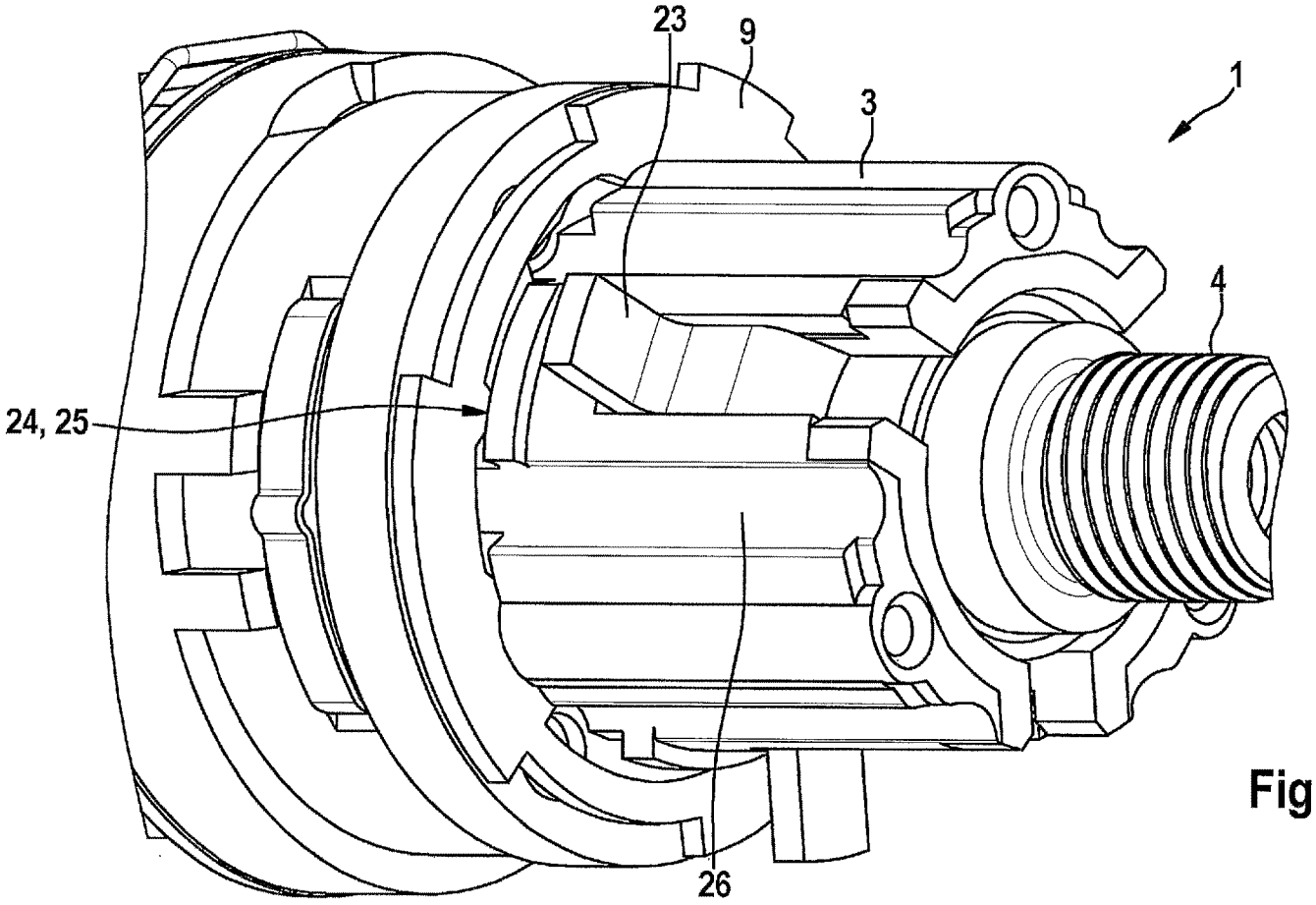
FIG. 5 shows the power drill in the boring position.

As may be seen in FIG. 2 in connection with FIG. 3, on supporting ring 8 a salient protuberance 8*a* is situated, axially in the direction of the free end face of tool spindle 4, which is a part of the adjusting contour on the supporting ring. Just as FIG. 4, FIG. 2 shows the percussion drilling position in which locking part 23 is located outside of axially prominent protuberance 8*a*. Consequently, latching disk 17, which is connected to locking part 23, is able to be in latching engagement with latching pot 16 because of the force of spring element 18, whereby the percussion drilling function is implemented. If, on the other hand, locking part 23 is rotated so far, by an operation of mode setting sleeve 5, that locking part 23 lies against axially prominent protuberance 8*a* of supporting ring 8, latching disk 17 is located axially at a distance from latching pot 16, and thus disengaged from the latching pot. These disengaged positions are implemented in the case of drilling (FIG. 5) and screwing (FIGS. 6, 7).

Thrust ring 9, both in the percussion drilling function (FIG. 4) and in the drilling function (FIG. 5), is fixed axially in form-locking to gear housing 3, and is only able to be adjusted in the rotational direction, so that an axial relative motion of thrust ring 9 with respect to gear housing 3 is excluded. In order to lock in the axial direction, a projection 24 pointing radially inwards on thrust ring 9 engages in a circumferential groove 25 on gear housing 3, so that thrust ring 9, via its projection 24 pointing radially inwards, is accommodated in circumferential groove 25 with form locking. In addition, on the lateral surface of housing 3, at regular distances, a plurality of axial grooves 26 have been inserted, that extend up to circumferential groove 25. In the region of axial grooves 26, there is an undercut between projections 24 on thrust ring 9 and circumferential groove 25, so that thrust ring 9 is freely movable in the axial direction. This situation is shown in FIGS. 6 and 7, which show the screwing position.

Figure 6:
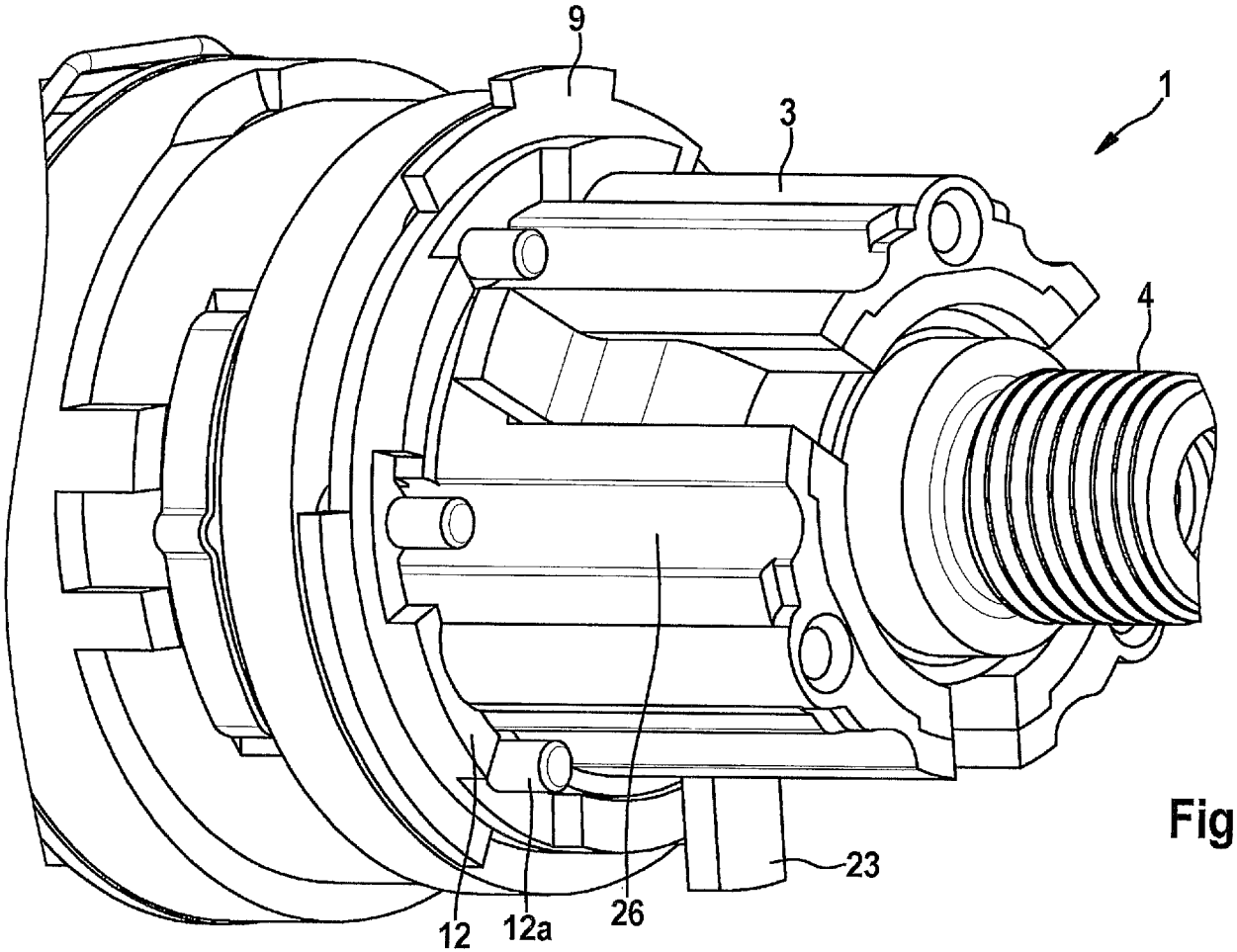
FIG. 6 shows the power drill in the screwing position.

In FIG. 6, power drill 1 is shown with first spring retaining ring 12 that has been mounted, which is a component of the spring device for the axial pressure application of thrust ring 9. In FIG. 7, power drill 1 is shown for a better representation without spring retaining ring 12. In FIGS. 6 and 7, thrust ring 9 is shown in the same circumferential positions in which the power drill is in the screwing position.

Figure 7:
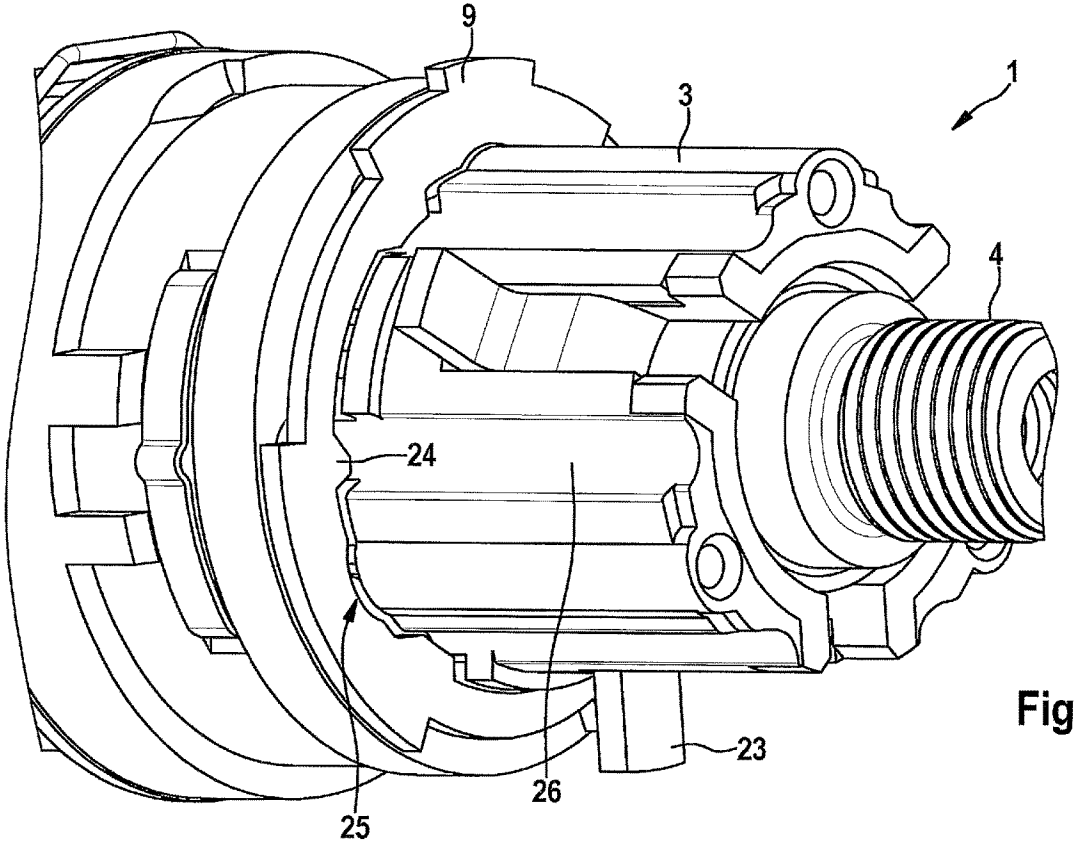
FIG. 7 shows an additional view of the power drill in the screwing position, but without a spring retainer which is a component of a spring device for applying force to a thrust ring on the gear housing.

As may be seen particularly in FIG. 7, projection 24, pointing radially inwards on thrust ring 9, is located in a rotational position in which projection 24 projects into axial groove 26 on gear housing 3 Thus, thrust ring 9 is able to be shifted with projections 24 axially along axial groove 26 against the force of the spring device.

As may be seen in FIG. 6, a plurality of studs 12*a* is situated distributed over the circumference on first retaining ring 12, onto which the individual spring elements are able to be plugged.

Divided over the circumference, a plurality of projections 24, pointing radially inwards are situated on thrust ring 9 which, in the screwing function, project into associated axial grooves 26 on gear housing 3.

What is claimed is:

1. A power drill having a percussion drilling function, a drilling function and a screwing function, comprising:

a gearing for transmitting the drive motion of a drive unit to a tool spindle;

two latching elements which in a percussion drilling position are in latching engagement and in a drilling position and a screwing position are disengaged;

a mode setting device including a supporting ring, wherein the mode setting device is rotatable by manual operation; and a thrust ring coupled to the supporting ring, in a torsionally fixed manner, which is supported on a gear housing of the gearing, by the rotation of the mode setting device the desired mode being able to be set, wherein the thrust ring in the screwing position is held axially displaceably on the gear housing and in the percussion drilling position and in the drilling position is fixed axially on the gear housing;

wherein one of the latching elements is held axially adjustably, and the axially adjustably held latching element or a component connected to the axially adjustably held latching element is supported on an adjusting contour on the supporting ring for transferring between the percussion drilling function and the drilling function or screwing function, wherein the thrust ring includes at least one radially inwardly projecting protrusion which is accommodated in a circumferential groove on the gear housing for axially form-locking the thrust ring on the gear housing in the drilling and the percussion drilling function.

2. The power drill of claim 1, wherein the tool spindle is held axially adjustable with respect to the gear housing, for transferring between the percussion drilling position and the drilling position or the screwing position.

3. The power drill of claim 1, wherein the thrust ring is held in the axially fixed position, axially form-locking on the gear housing.

4. The power drill of claim 1, wherein at least one axially projecting shoulder is formed on the supporting ring which, for coupling in the rotational direction, engages in a corresponding recess on the thrust ring.

5. The power drill of claim 1, wherein the supporting ring encompasses the thrust ring at least partially.

6. The power drill of claim 1, wherein a locking part coupled to the latching element is supported on the adjusting contour on the supporting ring.

7. The power drill of claim 1, wherein a spring device having two spring retaining rings and at least one spring element lying in-between is provided for the axial application of force to the thrust ring.

8. The power drill of claim 7, wherein one of the two spring retaining rings facing away from the thrust ring is to be adjusted axially by a torque setting sleeve.

9. The power drill of claim 7, wherein one of the two spring retaining rings contacting the thrust ring is encompassed by the supporting ring.

10. The power drill of claim 8, wherein the torque setting sleeve is acted upon with a latching torque by a latching spring element.

11. The power drill of claim 1, wherein the thrust ring in the screwing position is held axially displaceably on the gear housing such that when the torque exceeds an adjustable threshold value, the thrust ring is configured to lift off axially from the gear housing.

12. The power drill of claim 1, wherein the mode setting device includes a manually operable mode setting sleeve which is rotatably supported relative to the gear housing about a longitudinal axis of the power drill to set the percussion drilling function, drilling function and screwing function.

13. The power drill of claim 1, wherein the thrust ring in the screwing position is held axially displaceably relative to the supporting ring.

14. The power drill of claim 1, wherein the adjusting contour is arranged on an end face of the supporting ring and the adjusting contour includes axial height changes which are transmitted onto the latching disk via the locking part such that the latching disk changes its corresponding axial position.

15. The power drill of claim 1, wherein the at least one radially inwardly projecting protrusion which is accommodated in an axial groove on the gear housing for holding the thrust ring axially displaceably on the gear housing in the screwing function.

16. A power drill having a percussion drilling function, a drilling function and a screwing function, comprising:

a gearing for transmitting the drive motion of a drive unit to a tool spindle;

two latching elements which in a percussion drilling position are in latching engagement and in a drilling position and a screwing position are disengaged;

a mode setting device including a supporting ring, wherein the mode setting device is rotatable by manual operation; and a thrust ring coupled to the supporting ring, in a torsionally fixed manner, which is supported on a gear housing of the gearing, by the rotation of the mode setting device the desired mode being able to be set, wherein the thrust ring in the screwing position is held axially displaceably on the gear housing and in the percussion drilling position and in the drilling position is fixed axially on the gear housing;

wherein one of the latching elements is held axially adjustably, and the axially adjustably held latching element or a component connected to the axially adjustably held latching element is supported on an adjusting contour on the supporting ring for transferring between the percussion drilling function and the drilling function or screwing function, wherein the adjusting contour is arranged on an end face of the supporting ring and the adjusting contour includes axial height changes which are transmitted onto the latching disk via the locking part such that the latching disk changes its corresponding axial position.

* * * * *